US011849841B2

(12) United States Patent
Spreen

(10) Patent No.: US 11,849,841 B2
(45) Date of Patent: Dec. 26, 2023

(54) OPERATING DEVICE FOR A TABLE, AND TABLE COMPRISING SAME

(71) Applicant: Oelschläger Metalltechnik GmbH, Hoya/Weser (DE)

(72) Inventor: Andreas Spreen, Sternwehe-Oppenwehe (DE)

(73) Assignee: Oelschläger Metalltechnik GmbH, Hoya/Weser (DE)

( * ) Notice: Subject to any disclaimer, the term of this patent is extended or adjusted under 35 U.S.C. 154(b) by 120 days.

(21) Appl. No.: 17/612,846

(22) PCT Filed: May 19, 2020

(86) PCT No.: PCT/DE2020/100436
§ 371 (c)(1),
(2) Date: Nov. 19, 2021

(87) PCT Pub. No.: WO2020/233750
PCT Pub. Date: Nov. 26, 2020

(65) Prior Publication Data

US 2022/0312952 A1 Oct. 6, 2022

(30) Foreign Application Priority Data

May 20, 2019 (DE) ..... 202019002176.0

(51) Int. Cl.
*A47B 9/00* (2006.01)

(52) U.S. Cl.
CPC ..... *A47B 9/00* (2013.01); *A47B 2200/008* (2013.01); *A47B 2200/0042* (2013.01)

(58) Field of Classification Search
CPC ..... A47B 9/00; A47B 2009/003; A47B 2200/0041; A47B 2200/008; A47B 2200/0081
(Continued)

(56) References Cited

U.S. PATENT DOCUMENTS 6,286,441 B1 * 9/2001 Burdi ..... A47B 9/00 108/147
6,352,037 B1 * 3/2002 Doyle ..... A47B 9/00 108/50.02
(Continued)

FOREIGN PATENT DOCUMENTS

DE 102016115244 A1 * 3/2017 ..... A47C 20/041
WO 2018223240 A1 12/2018

*Primary Examiner* — Jose V Chen
(74) *Attorney, Agent, or Firm* — Jonathan M. D'Silva; MMI Intellectual Property

(57) ABSTRACT

The invention relates to an operating device for a table, having a table panel with an adjustable height and/or inclination and having an internal collision detection device for detecting a collision between the table panel and an object or a person, comprising: a control unit and a hand-held switch that is connected to the control unit and has a display element, on which an element can be displayed for menu navigation, and one or more command buttons, by means of which the height and/or inclination of the table can be adjusted using the menu navigation, wherein at least one of the command buttons is assigned multiple times, and parameters of the table can be adjusted using the command buttons with multiple assignments, said parameters comprising a sensitivity level of the collision detection device.

28 Claims, 6 Drawing Sheets

(58) Field of Classification Search
USPC ..... 108/144.11, 147, 50.02, 50.01
See application file for complete search history.

(56) References Cited

U.S. PATENT DOCUMENTS

| | | | | |
|---|---|---|---|---|
| 6,595,144 | B1 * | 7/2003 | Doyle | A47B 9/00 248/188.4 |
| 6,796,247 | B1 * | 9/2004 | Iglseder | G06K 7/10336 108/50.01 |
| 8,947,215 | B2 * | 2/2015 | Mandel | G06Q 10/109 248/188.4 |
| 9,700,136 | B1 * | 7/2017 | Zebarjad | A47B 9/02 |
| 9,921,726 | B1 * | 3/2018 | Sculley | H04L 67/12 |
| 9,969,216 | B2 * | 5/2018 | Sigal | B60B 33/0094 |
| 9,999,971 | B2 * | 6/2018 | Charlton | B25H 1/02 |
| 10,085,562 | B1 * | 10/2018 | Labrosse | G05B 19/406 |
| 10,114,352 | B2 * | 10/2018 | Matlin | G05B 15/02 |
| 10,398,233 | B2 * | 9/2019 | Hoyt | A47C 7/56 |
| 10,405,647 | B2 * | 9/2019 | Laudadio | A47B 21/02 |
| 10,455,932 | B2 * | 10/2019 | Lin | A47B 9/00 |
| 10,588,403 | B2 * | 3/2020 | Paul | A47B 9/02 |
| 10,646,033 | B2 * | 5/2020 | Lindblad | A47B 3/00 |
| 10,827,829 | B1 * | 11/2020 | Labrosse | A47B 21/06 |
| 11,044,990 | B2 * | 6/2021 | Xiang | F16P 3/144 |
| 11,058,216 | B2 * | 7/2021 | Hansen | A47B 9/00 |
| 11,071,377 | B2 * | 7/2021 | Lindblad | A47B 9/12 |
| 2010/0198374 | A1 * | 8/2010 | Carson | G06Q 10/00 340/6.1 |
| 2014/0096706 | A1 * | 4/2014 | Labrosse | G05B 19/048 108/21 |
| 2014/0285959 | A1 * | 9/2014 | Riley | A47B 21/00 108/50.01 |
| 2015/0120238 | A1 * | 4/2015 | Marvit | A47B 9/00 702/152 |
| 2016/0231731 | A1 * | 8/2016 | Carver | A47B 21/00 |
| 2016/0260019 | A1 * | 9/2016 | Riquelme Ruiz | G06N 20/00 |
| 2016/0353880 | A1 * | 12/2016 | Sigal | A47B 9/00 |
| 2017/0000254 | A1 * | 1/2017 | Matlin | A47B 9/10 |
| 2017/0055720 | A1 * | 3/2017 | Lin | A47C 20/041 |
| 2017/0135587 | A1 * | 5/2017 | Desroches | A61B 5/02055 |
| 2019/0082823 | A1 * | 3/2019 | Applegate | A47B 1/08 |
| 2020/0170407 | A1 * | 6/2020 | Knapp | A47B 9/00 |
| 2020/0329861 | A1 * | 10/2020 | Zhang | A47C 7/72 |
| 2023/0101727 | A1 * | 3/2023 | Albers | A47B 21/02 108/147 |

* cited by examiner

OPERATING DEVICE FOR A TABLE, AND TABLE COMPRISING SAME

BACKGROUND

The present invention relates to an operating device for a table which has a table top with an adjustable height and/or inclination.

In addition, the application relates to a table comprising a table top with an adjustable height and/or inclination.

Tables with electrically movable table tops are known from the prior art. In these, a displacement operation is controlled by a manual switch and a control unit that is connected to the manual switch and mounted on the table. The control unit controls electric motors in the table. The manual switch sends commands to the control unit, which, for example, moves the tabletop upwards or downwards or changes its inclination. However, parameters such as displacement speed or minimum table height must be configured before the table is used for the first time. The configuration of the parameters is carried out either by a table installer, usually during a manufacturing process of the table following assembly, or else pre-configured controls are used. To configure or modify the parameters, an external computer is connected to the control unit via a data connection via cable, WLAN or BLUETOOTH. The data of the control unit is converted into data that can be read by the external computer. The parameters are set via a complex configuration software on the external computer.

The control unit is in the configuration mode while the parameters are being set. In configuration mode, the external computer takes over the master control, while the manual switch is connected to the control unit as a slave.

The current configuration of the parameters requires a great deal of the table installer's time and delays the production process.

SUMMARY

The object of the present invention is therefore to provide a device that simplifies the configuration of a table that with an adjustable height and/or inclination.

According to the invention, this object is achieved by an operating device for a table having a table top with an adjustable height and/or inclination, comprising: a control unit and a manual switch that is connected to the control unit and comprises a display element on which an item of a menu navigation can be displayed, and one or more command buttons that allow the height and/or inclination of the table to be adjusted using the menu navigation, wherein at least one of the one or more command buttons is assigned multiple times and the multiple assignment of the command buttons can be adjust parameters of the table, and wherein the parameters include a sensitivity of the collision detection device.

The display element advantageously comprises an LCD display.

In a particular embodiment of the invention, it can be provided that the table additionally has an internal collision detection device for detecting a collision between the table top and an object or person, and wherein the parameters include a sensitivity of the collision detection device. The sensitivity of the collision detection can be, for example, a threshold value of a sensor, in which case the sensor detects a collision when the threshold value is exceeded.

It can also be provided that the sensitivity of the collision detection device can be adjusted separately for the displacement directions 'up' and 'down'.

In one of the last two embodiments mentioned it can be provided that the collision detection device also has an inclination sensor and the sensitivity of the inclination sensor can be adjusted separately for the displacement directions 'up' and 'down'.

In another particular embodiment of the invention, the menu navigation has a start menu, a main menu subordinate to the start menu, and a sub-menu subordinate to the main menu.

As an optional setting, the table height can be displayed on the display element in inches or centimeters.

One parameter is advantageously an absolute minimum table height.

Alternatively or in addition, it can be provided that a parameter is an absolute maximum table top height.

Optionally, a parameter can be provided as an absolute minimum inclination angle of the table top.

Alternatively or in addition, it may be provided that a parameter is an absolute maximum inclination angle of the tabletop.

Optionally, one of the parameters is the displacement speed of the tabletop.

In another particular embodiment of the invention, the menu navigation is protected by an input code, for example a PIN.

Preferably, one or more functions of the table, such as starting up, shutting down and/or menu panels, can be activated and deactivated.

It may also be possible to call up the identification number of the control box via the menu navigation.

One or more communication protocols, in particular WLAN and/or Bluetooth, can preferably be activated via the menu navigation.

In addition, the object is achieved by a table comprising a table top with an adjustable height and/or inclination, and an operating device according to one of the previously described embodiments of the invention.

In the latter embodiment, it may be provided that the table also comprises an internal collision detection device for detecting a collision between the table top and an object or person.

BRIEF DESCRIPTION OF DRAWINGS

Further features and advantages of the invention are obtained from the attached claims and the following description of a particular embodiment of the invention in combination with schematic drawings, in which:

DETAILED DESCRIPTION

Figure 1:
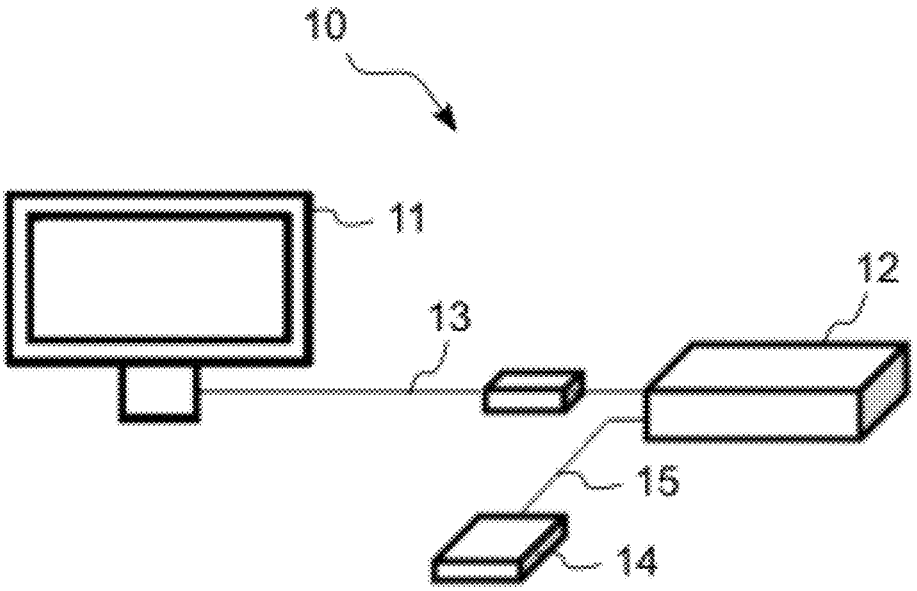
Figure 1 (Prior art)
FIG. 1 shows a perspective view of an operating device according to the prior art.
Figure 2:
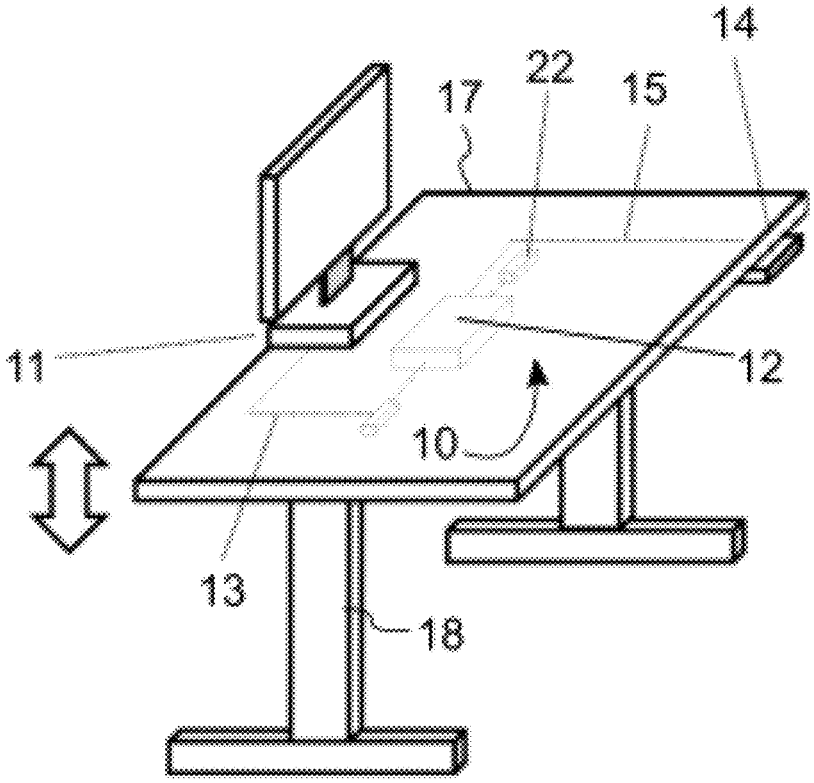
Figure 2 (Prior art)
FIG. 2 shows an arrangement of the operating device of FIG. 1 on a table.

FIGS. 1 and 2 show a perspective view of an operating device 10 for a height-adjustable table according to the prior art. The operating device comprises a control unit 12, a manual switch 14, and a cable 15. In order to configure the operating device 10, a configuration computer 11 is connected to a control unit 12 for controlling, for example, motors for height and/or inclination adjustment of a table top via a cable 13 of a human interface device (HID). Furthermore, a manual switch 14 is also connected to the control unit 12 via a cable 15. The manual switch 14 can be used to set displacement parameters of an adjustable table, such as a height and/or inclination of the table top. For this purpose, command buttons (not shown in detail) can be provided in the manual switch 14. To configure parameters a software on the configuration computer 11 is used, by means of which parameters such as a sensitivity of the collision detection device can be set. In configuration mode, the software in the configuration computer 11 takes over the master control via the control unit 12. In this configuration, the manual switch 14 remains connected to the control unit 12 as a slave and subordinate to the configuration computer 11.

FIG. 2 shows the operating device 10 of FIG. 1 on a table 16. The table 16 comprises a table top 17 and table legs 18. The height and/or inclination of the table top 17 can be adjusted, as indicated by the arrow shown to the left of the table top 17. In addition, the table 16 is equipped with a collision detection device (not explicitly shown). The collision detection device is used to detect a collision of the table top 17 with an object or a person during a displacement operation and can comprise sensors 22, such as acceleration sensors, for this purpose. The operating device 10 is arranged underneath the table top 17. For configuration purposes, the configuration computer 11 is temporarily located on the tabletop 17, for example, and is connected to the control unit 12. The manual switch 14 is located underneath the table top 17 on a front side of the table top 17. As also shown in FIG. 1, the manual switch 14 is connected to the control unit 12 via a cable 15. The control unit 12 is used to control the table. The cable 15 is also arranged underneath the table top 17. In addition, a sensor 22 is connected to the collision detection device. For example, the sensor 22 can be designed as an acceleration sensor and/or position sensor and is used to send a signal to the collision detection device in the event of a collision of the table top 17 during a displacement operation. The collision detection device checks whether the signal originates from a collision. For this purpose, the collision detection device can check whether the signal exceeds a specified threshold value, for example. If the result of the test is positive, the collision detection device sends a collision signal to the control unit 12. If the control unit receives a collision signal, it interrupts a current displacement operation. The configuration of the control unit 12 is carried out in the prior art shown here via the configuration computer 11. The height of the table 16 is controlled by the manual switch 14 and the control unit 12.

Figure 3:
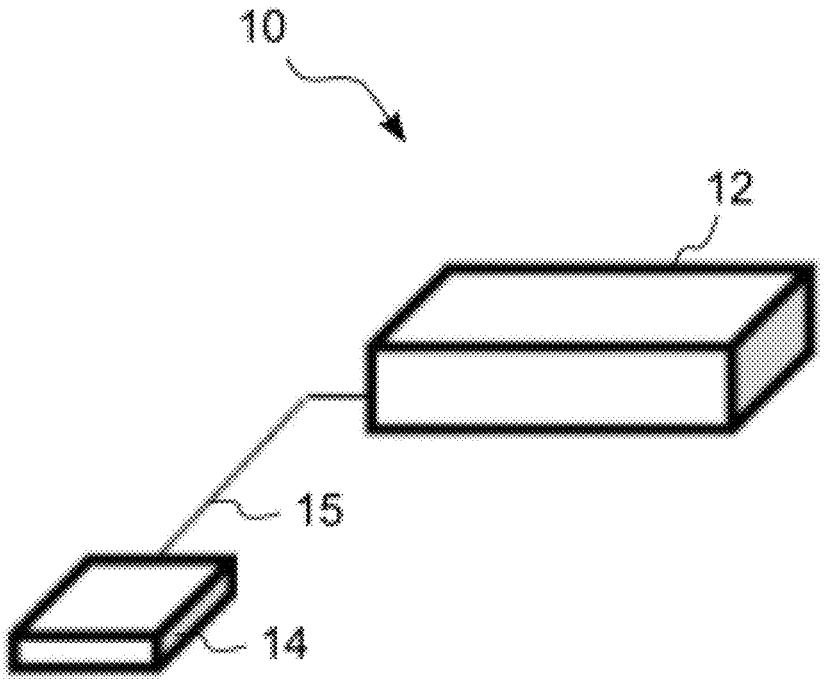
FIG. 3 shows a perspective view of an operating device according to a particular embodiment of the invention.

FIG. 3 shows a perspective view of an operating device 10 according to a particular embodiment of the invention. The control device 10 comprises a control unit 12 and a manual switch 14, which are connected to each other with a cable 15. Alternatively, the control unit 12 and the manual switch 14 can be connected to each other via a wireless connection. The manual switch 14 can be used to set displacement parameters of an adjustable table 16 (see FIG. 4), such as a height and/or an inclination of the table 16. In this configuration, it is also possible to set parameters by means of the manual switch 14, such as a sensitivity of a collision detection device of the table 16, a displacement speed, and/or a minimum table height that must not be undershot. The manual switch 14 is preferably equipped with a display element 30. In addition, the manual switch 14 can have command buttons 32, 34 and/or a menu button 36. The display element 30, the command buttons 32, 34 and the menu button 36 can be used to set the displacement parameters and the parameters. For this purpose, the display element 30 displays elements from an intuitive menu navigation, which is explained in more detail in conjunction with FIGS. 5 and 6. Using the manual switch 14, it is possible to set all the displacement parameters and parameters of the control unit 12 according to the invention, so that a configuration of the control unit is possible without the need to connect an external configuration computer. Due to the simple operability of the manual switch, the settings can also be implemented by the end user so that the use of a table installer can be dispensed with.

Figure 4:
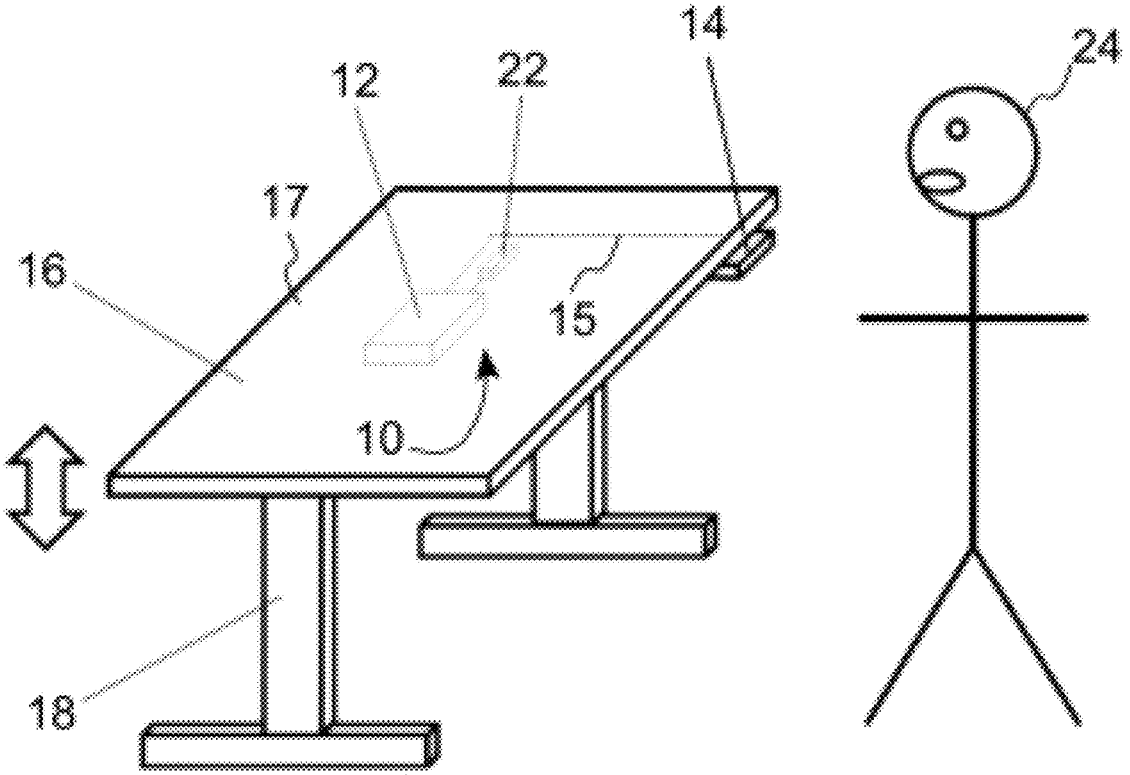
FIG. 4 shows an arrangement of the operating device of FIG. 3 on a table.

FIG. 4 shows an arrangement of the operating device 10 according to the invention of FIG. 3 on a table 16. The table 16 comprises a table top 17 with an adjustable height and/or inclination, table legs 18, and a collision detection device (also not shown here). An operating device 10 is located under the table top 17 and has a manual switch 14 in addition to the control unit 12, the sensor 22 and the cable 24. In contrast to the prior art shown in FIG. 2, the operating device 10 does not have a configuration computer 11. A user 24 can implement both the settings of the displacement parameters and the settings of the parameters via the manual switch 14. For example, sensor 22 can be arranged outside the control unit 12 or inside the control unit 12. Alternatively, a plurality of sensors can be located both inside and outside the control unit 12. The plurality of sensors can be designed identically or differently. For example, the sensor 22, or each of the plurality of sensors 22, can have an acceleration sensor and/or an angle sensor and be configured to send a signal to the collision detection unit in the event of a collision between the table top 17 and an object or a person 24. For example, the collision detection unit checks whether the signal exceeds a specified threshold value and sends a collision signal to the control unit 12 if the result is positive. Whenever the control unit 12 receives a collision signal, it stops a current displacement operation. A threshold value for triggering a collision signal and stopping a displacement operation can preferably be between 20 and 200 N, particularly preferably between 50 and 150 N.

Figure 5:
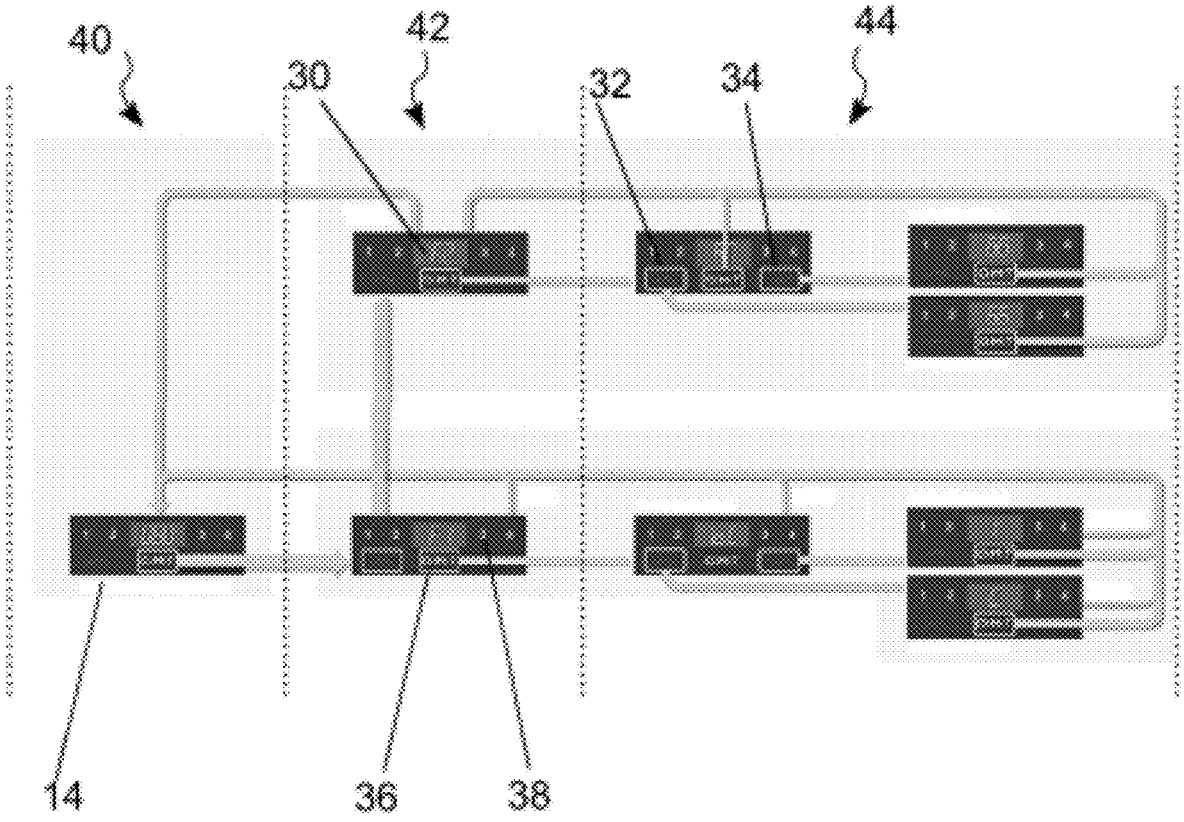
FIG. 5 shows a diagram with a sequence of states of different settings of a manual switch according to a particular embodiment of the invention.
Figure 6:
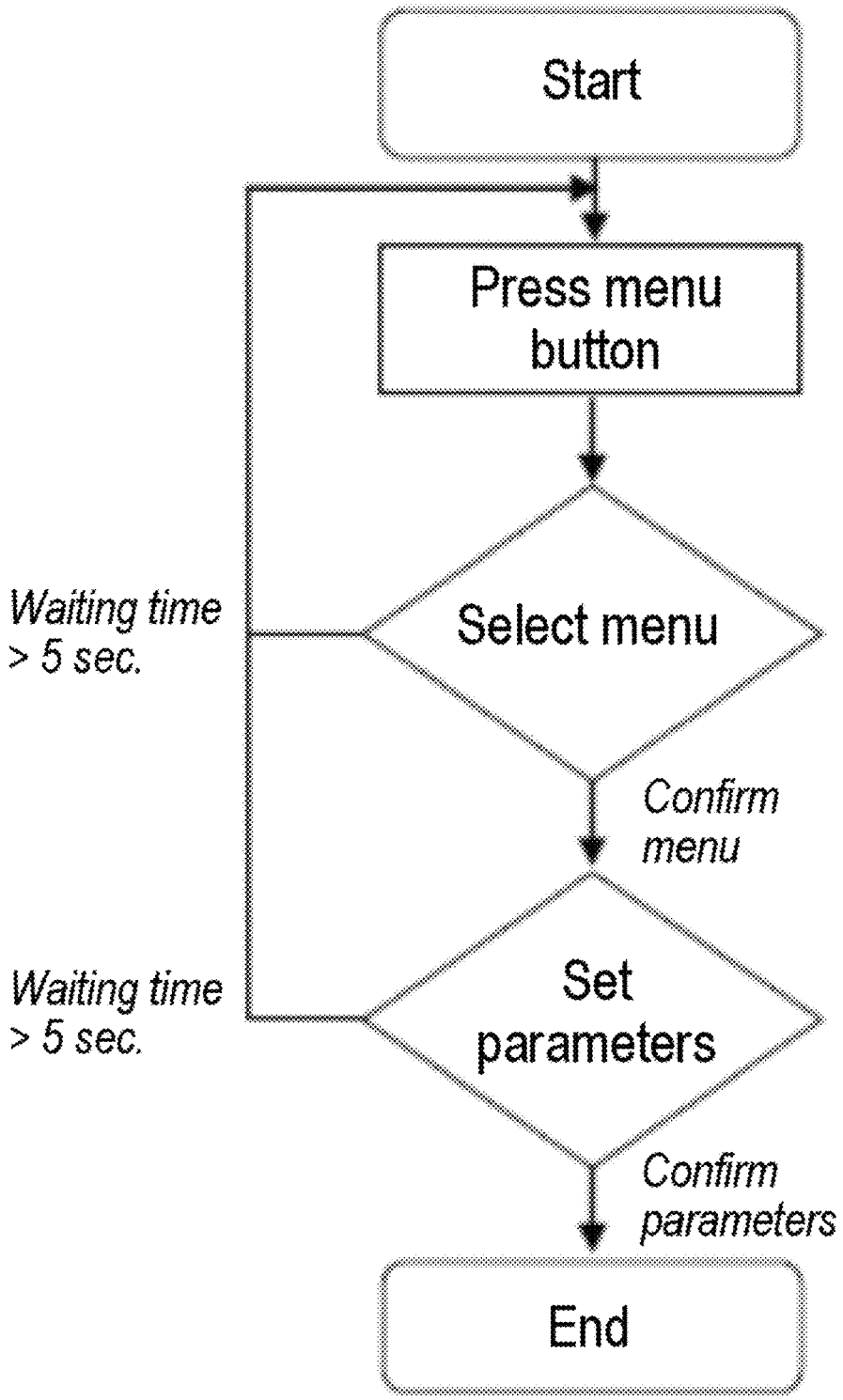
FIG. 6 shows a flowchart of the menu navigation according to the embodiment of the invention shown in FIG. 5 in a simplified view.

FIG. 5 shows a diagram with a sequence of states of different settings of a manual switch 14 of an operating device 10 according to a particular embodiment of the invention. FIG. 6 shows a flow diagram of the same embodiment in a simplified view. The manual switch 14 comprises a display element 30, a command button 'up' 32, a command button 'down' 34, a menu button 36, and stored position buttons 38 for stored positions 1 to 4. The stored position buttons 38 can be used to store or retrieve position settings of the table 16. The display element 30 is designed as an LCD display in this particular embodiment of the invention. Alternatively, the display element 30 can also be designed as an LED display, OLED display or in some other form. The display element 30 can be used to display elements of the menu navigation.

The menu navigation shown in FIG. 5 is explained below. If no interaction with the operating device 10 has taken place over a specified period of time, the display element 30 is located in the start menu 40 shown on the left in FIG. 5. The display element 30 indicates a height of the table top 17 in centimeters or inches, according to a previously selected setting. Pressing the menu button 36 takes the user to the main menu 42 shown on the right of the start menu 40. The display element 30 displays a menu navigation item associated with the main menu 42. If the user is in the main menu 42, pressing one of the command buttons 32, 34 allows one of at least ten different functions (F1 to F10) to be selected and confirmed with the menu button 36. For each function, a different menu navigation item is displayed on the display element 30. After confirming a selected function using the menu button 36, the sub-menu 44 associated with the respective function (F1 to F10) is reached. The functions comprise:

Function 1: Setting inches/cm for the display of the table height in the start menu, Function 2: Setting the absolute minimum table height, Function 3: Reverting to factory setting, Function 4: Setting shelf/container stop, Function 5: Deleting shelf/container stop, Function 6: Setting the sensitivity of the internal collision protection from 0 (off) to 99 (very sensitive) for the displacement direction 'up', Function 7: Setting the sensitivity of the internal collision protection from 0 (off) to 99 (very sensitive) for the displacement direction 'down', Function 8: Setting the sensitivity of the inclination sensor from 0 (off) to 99 (very sensitive) for the displacement direction 'up', Function 9: Setting the sensitivity of the inclination sensor from 0 (off) to 99 (very sensitive) for the displacement direction 'down', Function 10: Setting the displacement speed in mm/s.

In the sub-menu 44 associated with the respective function, the settings belonging to the function can be selected by pressing the command buttons 32, 34. The selection is displayed on the display element 30. Pressing the menu button 36 confirms the selection and returns to displaying the main menu 42. Optionally, if the operating device 10 is in the sub-menu 44 for a specified waiting time, without any input being received, the main menu 42 is also displayed again, but without accepting any altered settings. The specified waiting time can be 10 seconds, for example. Optionally, it can also be provided that if the operating device 10 is in the main menu 42 and no input is received for a second specified waiting time, the start menu 40 is also displayed again. The second specified waiting time can again be 10 seconds, for example.

The currently selected height and/or inclination settings of the table 16 can be stored on one of the stored position buttons 38. For this purpose, it may be provided that one of the stored position buttons 38 is pressed for a specified period of time. For example, the specified time period can be 3 seconds. An option can also be provided to retrieve the height and/or inclination settings of the table 16 by briefly pressing a stored position button 38 on which a setting has previously been stored. This causes the stored height and/or inclination settings of the table 16 to be sent to the control unit 12 and the control unit moves the table top 17 into the previously stored position.

The features of the invention disclosed in the above description, the claims and the drawings can be essential to the implementation of the invention in its various embodiments, both individually and in any desired combination.

LIST OF REFERENCE SIGNS

10 operating device
11 configuration computer
12 control unit
13 HID cable
14 manual switch
15 cable
16 table
17 table top
18 table leg
22 sensor
24 person
30 display element
32 command button 'up'
34 command button 'down'
36 menu button
38 stored position button
40 start menu
42 main menu
44 sub-menu

The invention claimed is:

1. An operating device for a table, which has a table top with an adjustable height and/or inclination, comprising:
- a control unit; and
- a manual switch connected to said control unit comprising:
  - a display element on which an element for menu navigation can be displayed; and
  - one or more command buttons that allow the height and/or inclination of said table to be adjusted using said menu navigation; and
- said table also has an internal collision detection device for detecting a collision between said table top and an object or person,
- wherein at least one of said one or more command buttons is assigned multiple times and the multiple assignment of said command buttons can be used to adjust parameters of said table and wherein said parameters include a sensitivity of said collision detection device; and
- further comprising said sensitivity of said collision detection device can be adjusted separately for the displacement directions 'up' and 'down'.

2. The operating device of claim 1, further comprising said display element has an LCD display.

3. The operating device of claim 1, further comprising said collision detection device has an inclination sensor and the sensitivity of said inclination sensor can be adjusted separately for the displacement directions 'up' and 'down'.

4. The operating device of claim 1, further comprising said menu navigation has a start menu, a main menu subordinate to said start menu and a sub-menu subordinate to said main menu.

5. The operating device of claim 1, further comprising said table height in inches or centimeters can be displayed on said display element.

6. The operating device of claim 1, further comprising one of said parameters is an absolute minimum height of said table top.

7. The operating device of claim 1, further comprising one of said parameters is an absolute maximum height of said table top.

8. The operating device of claim 1, further comprising one of said parameters is an absolute minimum inclination angle of said table top.

9. The operating device of claim 1, further comprising one of said parameters is an absolute maximum inclination angle of said table top.

10. The operating device of claim 1, further comprising one of said parameters is the displacement speed of said table top.

11. The operating device of claim 1, further comprising said menu navigation is protected by an input code.

12. The operating device of claim 1, further comprising one or more functions of said table can be activated and deactivated.

13. The operating device of claim 1, further comprising the identification number of the control box can be retrieved via said menu navigation.

14. The operating device of claim 1, further comprising one or more communication protocols can be activated via said menu navigation.

15. A table, comprising a table top having an adjustable height and/or inclination and an operating device, comprising:

a control unit; and a manual switch connected to said control unit comprising:

a display element on which an element for menu navigation can be displayed; and one or more command buttons that allow the height and/or inclination of said table to be adjusted using said menu navigation; and said table also has an internal collision detection device for detecting a collision between said table top and an object or person, wherein at least one of said one or more command buttons is assigned multiple times and the multiple assignment of said command buttons can be used to adjust parameters of said table and wherein said parameters include a sensitivity of said collision detection device; and further comprising said sensitivity of said collision detection device can be adjusted separately for the displacement directions 'up' and 'down'.

16. The table of claim 15, further comprising said display element has an LCD display.

17. The table of claim 15 further comprising said collision detection device has an inclination sensor and the sensitivity of said inclination sensor can be adjusted separately for the displacement directions 'up' and 'down'.

18. The table of claim 15, further comprising said menu navigation has a start menu, a main menu subordinate to said start menu and a sub-menu subordinate to said main menu.

19. The table of claim 15, further comprising said table height in inches or centimeters can be displayed on said display element.

20. The table of claim 15, further comprising one of said parameters is an absolute minimum height of said table top.

21. The table of claim 15, further comprising one of said parameters is an absolute maximum height of said table top.

22. The table of claim 15, further comprising one of said parameters is an absolute minimum inclination angle of said table top.

23. The table of claim 15, further comprising one of said parameters is an absolute maximum inclination angle of said table top.

24. The table of claim 15, further comprising one of said parameters is the displacement speed of said table top.

25. The table of claim 15, further comprising said menu navigation is protected by an input code.

26. The table of claim 15, further comprising one or more functions of said table can be activated and deactivated.

27. The table of claim 15, further comprising the identification number of the control box can be retrieved via said menu navigation.

28. The table of claim 15, further comprising one or more communication protocols can be activated via said menu navigation.

* * * * *